US007561834B2

(12) United States Patent
Silence

(10) Patent No.: US 7,561,834 B2
(45) Date of Patent: Jul. 14, 2009

(54) DEVELOPER DISPENSE FOR ENHANCED STABILITY IN XEROGRAPHIC PRINTING SYSTEMS

(75) Inventor: Scott M. Silence, Fairport, NY (US)

(73) Assignee: Xerox Corporation, Norwalk, CT (US)

( * ) Notice: Subject to any disclaimer, the term of this patent is extended or adjusted under 35 U.S.C. 154(b) by 193 days.

(21) Appl. No.: 11/505,088

(22) Filed: Aug. 16, 2006

(65) Prior Publication Data

US 2008/0044190 A1 Feb. 21, 2008

(51) Int. Cl.
*G03G 15/06* (2006.01)

(52) U.S. Cl. ..... 399/258; 399/259; 399/27

(58) Field of Classification Search ..... 399/258, 399/259, 49, 267, 27, 29
See application file for complete search history.

(56) References Cited

U.S. PATENT DOCUMENTS 4,117,803 A * 10/1978 Kito ..... 399/119
4,614,165 A * 9/1986 Folkins et al. ..... 399/257
5,185,616 A * 2/1993 Wilcke ..... 347/140
5,548,385 A * 8/1996 Takai et al. ..... 399/62
5,592,270 A * 1/1997 Takai et al. ..... 399/260
5,652,947 A * 7/1997 Izumizaki ..... 399/58
6,587,661 B1 * 7/2003 Shimmura et al. ..... 399/257
6,665,502 B2 * 12/2003 Hirobe et al. ..... 399/49
2004/0170441 A1 * 9/2004 Forbes et al. ..... 399/27
2004/0170442 A1 * 9/2004 Forbes et al. ..... 399/27
2005/0163537 A1 * 7/2005 Muramatsu et al. ..... 399/258

* cited by examiner

*Primary Examiner*—David M Gray
*Assistant Examiner*—G. M. Hyder
(74) *Attorney, Agent, or Firm*—James J. Ralabate

(57) ABSTRACT

A two dispenser system is used to replenish developer and toner in an electrostatic marking system. This two dispenser system replenishes toner and developer in a more accurate way since each of the dispensers are individually controlled and operated. Better quality prints and less waste is provided over extended usage periods.

1 Claim, 2 Drawing Sheets

DEVELOPER DISPENSE FOR ENHANCED STABILITY IN XEROGRAPHIC PRINTING SYSTEMS

FIELD

This invention relates to marking systems and, more specifically, to electrostatic color and monochrome marking systems.

BACKGROUND

In the process of electrostatographic reproduction, a light image of an original to be copied or printed is typically recorded in the form of a latent electrostatic image upon a photosensitive member, with a subsequent rendering of the latent image visible by the application of electroscopic marking particles commonly referred to as toner. The visual toner image can be either fixed directly upon the photosensitive member or transferred from the member to another support medium, such as a sheet of plain paper. To render this toner image permanent, the image must be "fixed" or "fused" to the paper, generally by the application of heat and pressure.

With the advent of high speed monochrome and color marking machines, including xerography reproduction machines wherein copiers or printers can produce at a rate in excess of three thousand copies per hour, the need for improved developer performance is evident and useful.

A common goal in the design and development of electrostatographic printing devices is the ability to maintain optimum image quality from page to page and job to job regardless of the characteristics of the images being formed on each page. As should be appreciated, to maintain optimum image quality it is important that the printing device sustain good development as well as good transfer efficiency. Good development or good developability, refers to the ability of the device to transfer the appropriate amount of toner to the latent image when forming the toner powder image. Good transfer efficiency refers to the ability of the printing device to transfer the toner powder image to the substrate.

It is known that maintaining the state of the material in the developer housing within an optimum range improves developability and transfer efficiency. To accomplish this, many printing systems use a variety of processes to maintain the state of the developer materials within the optimum range by monitoring and controlling one or more characteristics of the materials including, for example, temperature, humidity, charge, toner concentration (ratio of toner to carrier) and toner charge distribution.

However, even if the developer materials are maintained in an optimal state, it has been observed that under certain conditions such as extended running of prints with low toner area coverage in one or more of the color separations, the developability and/or transfer efficiency can degrade due to changes in the materials state in the developer housing. A second such condition is running prints at any toner area coverage or range of area coverages for a prolonged period of time such that the average residence time of the carrier in the Xerographic housing surpasses some threshold value as measured in kiloprints (thousands of prints). This degradation in developability and/or transfer efficiency produces weak, mottled and/or streaky images even with the enablement of Xerographic process controls system using all of the printer's operating space to optimize the image quality of the prints. With existing printing devices, when running low area coverage prints or prints at any area coverage where the average residence time of the carrier in the Xerographic housing has surpassed some threshold value and a reduced image quality suspected to result from a degradation in developability or transfer efficiency is observed, it is known to address the problem by either changing the materials within the developer housing(s) or by running a large number of prints (e.g., 1 to 2 thousand) of a high area coverage document to remove "bad" toner from the developer housings.

Although replacing the materials within developer housing and/or running a large number of a high area coverage document can improve the developability and transfer efficiency and thus restore image quality, such procedures are both costly and time consuming as the user may be forced to interrupt the job and perform some service action on the printer. Additionally, the above processes can result in a substantial waste of toner, carrier and/or paper resources. Furthermore, as the problem must first be identified and diagnosed by an operator before any corrective action can be taken, there is the possibility of a substantial loss in productivity resulting from the loss of a large number of pages before detection of a problem or from dedicating an operator to monitor the job to detect potential problems.

In electrostatic development processes, a developer material is used comprising relatively large carrier beads that have fine toner particles electrostatically coated thereon. Various known means are used to convey these toner particles to the latent electrostatic image on the photoconductive surface. The composition of the carrier particles is so chosen as to electrostatically attract and hold the toner particles for transfer to the latent image. As the developer is directly or indirectly contacted with this photoconductor surface, the toner particles are electrostatically deposited and secured to the charged portion of this latent image and not deposited on the uncharged or background portion of the image. The carrier and excess toner are then recycled for later use but eventually after extended use become ready to be removed from the system to be replenished with new toner and carrier.

The root cause of the development (and transfer) degradation is well known; a loss of additive functionality on the toners as the average residence time of the toner increases in the housing during low AC printing. While this issue is mitigated to a large extent by design of the Xerographic toners, there exists a need to further address the problem by design of the printing engines themselves. Currently, customers may need to maintain toner throughput in a Xerographic housing at higher levels than that required to print the image content of customer jobs, for example by running high area coverage prints, developing toner to unimaged areas of the photoconductor which moves directly to the cleaning subsystem, (either when the printer is being used to run customer jobs or when it is removed from printing those jobs) and/or by changing developers when the image quality visually degrades or a system actuator, for example a development voltage reaches a critical value. (See commonly-owned U.S. Pat. No. 7,079,794 B2, the disclosure which is incorporated herein by reference.) There are substantial disadvantages to this strategy in customer flexibility, waste and downtime, and the need for a better solution is universally recognized. Introducing only fresh toner through an existing replenisher dispensing device without a corresponding withdrawal of toner from the developer housing (for example, by the mechanisms discussed above) is not a satisfactory option as such a process changes (increases) the toner concentration (TC) in a low throughput mode, quickly pushing the machine above the high TC operating boundary and bringing on a different set of image quality failures. A better way to introduce fresh toner and developer with the requisite better developability and transfer efficiency is provided by embodiments of this invention.

SUMMARY

This invention provides a substantial modification to the current system of toner replenisher dispense used in many of the Xerographic engines. Rather than one toner or replenisher dispenser, an additional dispenser for developer is introduced into the system, to be actuated independently of the toner or replenisher dispenser when a system sensor or actuator reaches a critical value in the housing. An example of such a sensor or actuator is the voltage required to develop an imaged area on the photoconductor to a certain average optical density level, as measured, for example, by an extended toner area coverage sensor (ETACS). An additional example of such a sensor or actuator is a sensor that detects variations in optical density in an imaged area over the full width of the photoconductor. A third example is a sensor that detects the level of toner that remains in an imaged area after an image has been transferred to the paper (residual toner mass on the photoreceptor). Other examples will be apparent to those of ordinary skill in the art. The first dispenser dispenses a replenishing material wherein a majority of the material by weight is toner particles and the second dispenser disperses a replenishing material wherein a majority of the material by weight are carrier particles. The material dispensed by the first dispenser can contain a major portion by weight of toner such as 51% to 100%, preferably 66% to 100% and most preferably from 80% to 100%. The material dispensed by the second dispenser can contain a major portion by weight of carrier such as 51% to 100%, preferably from 85% to 98% and most preferably from 92% to 97%. However, any suitable amount of each obviously can be used as long as it is a majority portion as specified. Dispensing developer (at the centerline toner concentration (TC), typically between 3% and 8% toner by weight) into a developer housing allows fresh toner and carrier particles to be introduced into the system without change to the TC of the material in the developer housing, preventing the image quality of the prints from degrading with the system process controls operating within the allowable operating space and allowing uninterrupted printing by the customers of low area coverage jobs without any page or toner waste.

In one embodiment, the total mass of developer in a developer housing is 3450 g.; a dispense rate of 100 grams per minute of developer from the second dispenser would allow up to 50% of the toner to be replaced in a space of less than 2000 prints without interruption of the engine. Operating in this manner, the second dispenser could be operated for a short period time (for example, for 20 minutes in an engine with a speed of 100 prints per minute) over which a substantial fraction of the toner and developer are replaced, and subsequently turned off until the system image quality was again near a degraded state. In a second embodiment, the total mass of developer in a developer housing is 3450 g.; a dispense rate of 5 grams per minute of developer from the second dispenser operating continuously would allow the entire developer originally in the housing to be replaced gradually at a continuous rate over time, In this embodiment, assuming that developer randomly exits the housing (that is, exits independently of when it entered the housing) the average residence time of the developer in the housing will approach 69 kiloprints. In a third embodiment, the total mass of developer in a developer housing is 3450 g.; a dispense rate which is variably controlled, operating continuously between 0 and 100 grams per minute of developer from the second dispenser would allow either the image quality to be maintained at a predetermined level of the average residence time of developer in the housing to be maintained at a predetermined level, either of which could optionally be selectable by the customer or determined automatically by a sensor or actuator in the Xerographic system. In any of these embodiments the excess developer exits the housing through the existing housing or trickle port.

Additional potential features of this invention are as follows:

The developer that is dispensed into the housing from the second dispenser may contain a toner that is compositionally different or is processed differently from that of the toner in the original developer or the toner dispensed from the first replenisher dispenser. For instance, the toner in the developer in the second dispenser may be optimized for high developability (i.e., has excess or less intensely blended additives on it), allowing the developability of the material in the sump to recover at a rate faster than dispensing nominal toner into it. No other method would exist for dispensing a low area coverage development optimized toner into the system on a job-by-job basis in a reasonably quantity without changing the sump toner concentration.

The amount of carrier in the replenisher dispensed by the first dispenser may be reduced to a much lower suitable value and, optionally eliminated from the replenisher entirely, minimizing the total amount of carrier dispensed into the system. In the current embodiment of dispense in many Xerographic engines, carrier is contained in the replenisher (generally referred to as "Trickle systems") to introduce fresh carrier into the developer housing to minimize the effect of aged carrier in the system which reduces tribo and developer conductivity.

The service or high frequency service interval (also referred to as "HFSI") for developer change to prevent degradation of image quality could be eliminated reducing the level of scheduled maintenance required for the marking engine.

Specific typical sensors used in the present invention are: extended toner area coverage sensor (ETACS), which may be used to monitor the average optical density level of an imaged area on the photoconductor or the optical density level of an imaged area after than image has been transferred to the paper, yielding a measure of residual toner mass on the photoreceptor; a full width array optical sensor which detects variations in optical density in an imaged area over the full width of the photoconductor; or an electrostatic voltage (ESV) sensor to determine the amount of charge that a developed toner layer imparts to a photoreceptor. Electrical and mechanical sensors are presently used in Xerox marking machines and any of these, if suitable, can be used as the first and second sensors of this invention.

The embodiments of this invention not only provide greatly improved image quality, but also have a very positive effect on minimizing developer waste. In one embodiment compared to previous used systems, a substantial waste reduction was accomplished. Using only a toner dispenser as in the prior art, and using 10 replenisher bottles overall, a total of 116 pounds of waste developer occurred. Using a first (toner) and second (developer) dispenser containing developer in an embodiment of this invention, under similar conditions, only 88 pounds of waste developer resulted.

It was found that not only does toner need to be replenished in electrostatic marking system in order to improve image quality over the long run, but it has been determined that old carrier needs to be replaced by a dispenser introducing new developer.

This invention permits one to add a developer dispense function as a retrofit within the development system. This would allow for independent dispensing of both developer and toner since first and second independently controlled dispensers are used. Currently most of the two component (toner and carrier) development systems only dispense replenisher, which is mostly toner, but has some amount of carrier to enable the trickle function. This is a good general strategy, but can be problematic when running, for example, low area coverage for extended periods of time because very little carrier gets replenished and performance can degrade.

By separating the toner and developer dispense functions, one can have more capability to independently control the toner and carrier state resulting in longer life materials. A number of sensors are used (at least one in the housing and at least one adjacent the photoconductor surface) to convey the image quality and thereby activate the dispensers (toner and developer) when poor image quality requires addition or replenishing of toner and/or developer.

DETAILED DISCUSSION OF DRAWINGS AND PREFERRED EMBODIMENTS

Figure 1:
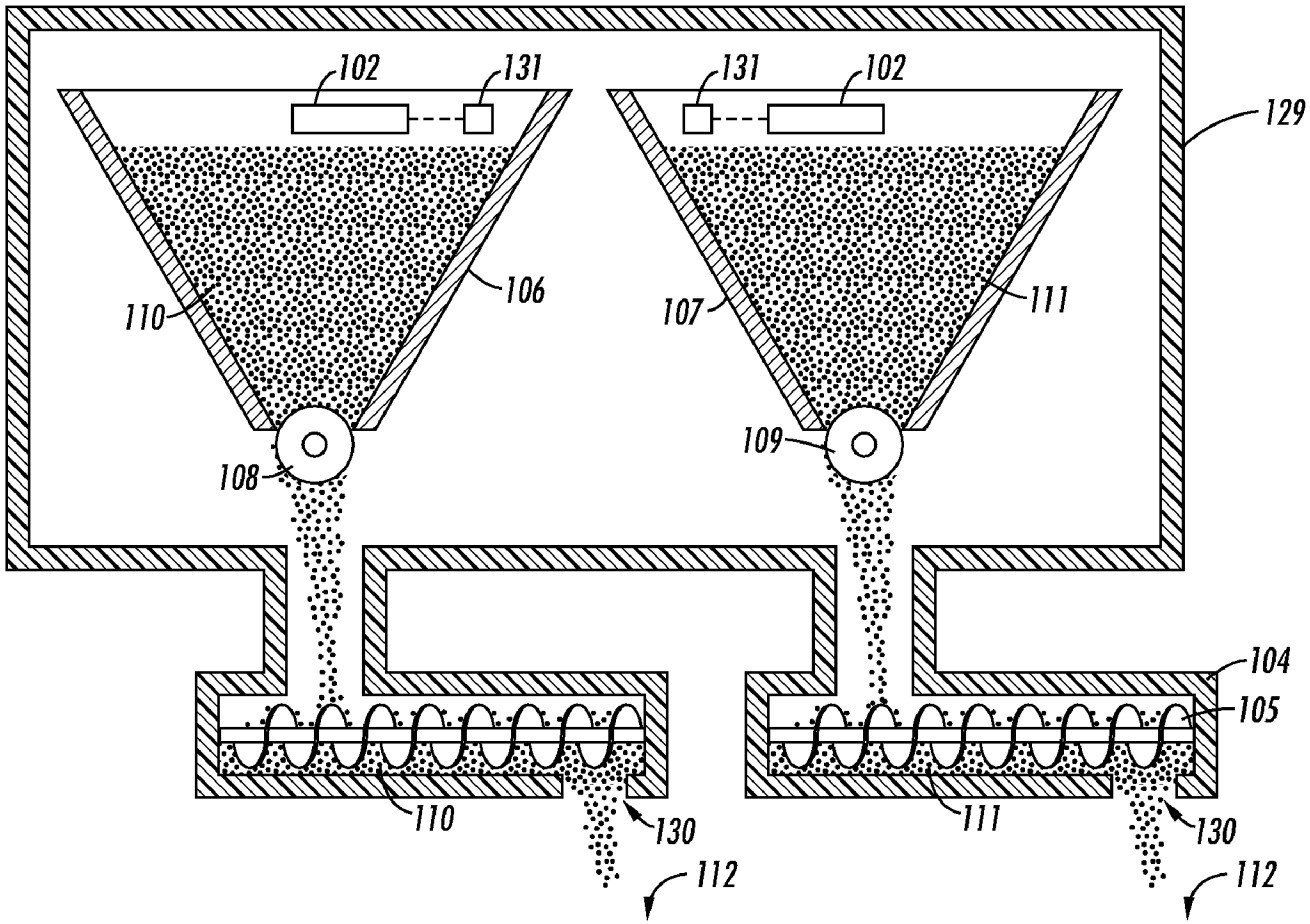
FIG. 1 illustrates an embodiment of the two dispenser system of this invention.

FIG. 1 depicts an embodiment of the two dispenser system 129 of this invention. The two dispenser system includes two open-ended hoppers 106 and 107, each having a dispensing regulator such as a foam roller 108 and 109, respectively, positioned in the open ends thereof. A supply of toner or replenisher material (comprising toner particles or a mixture of carrier particles and toner particles wherein the majority of mixture by weight is toner particles), referred to generally as material 110 is stored in hopper 106. A supply of developer material (comprising a mixture of carrier particles and toner particles wherein the majority of mixture by weight is carrier particles), referred to generally as material 111 is stored in hopper 107. As rollers 108 and 109 rotate the materials 110 and 111 are discharged from the hoppers 106 and 107 into the developer housing 101 and reservoir 112 shown in FIG. 2. The dispensing regulators 108 and 109 may be individually adjusted and controlled to regulate the dispense rates of materials 110 and 111 from hoppers 106 and 107. As rollers 108 and 109 rotate, materials 110 and 111 are discharged from dispensers 106 and 107 into a developer housing 101 and reservoir 112 shown in FIG. 2. These materials can be transported to the housing 101 and reservoir 112 by any suitable means such as a conveyor channel 104 using an auger 105 or a conveyer belt or any other suitable means. A sensor 131 or control 102 may be used in each dispenser 1(106) and dispenser 2 (107) to regulate and control the flow of materials 110 and 111 out of dispensers 106 and 107.

Figure 2:
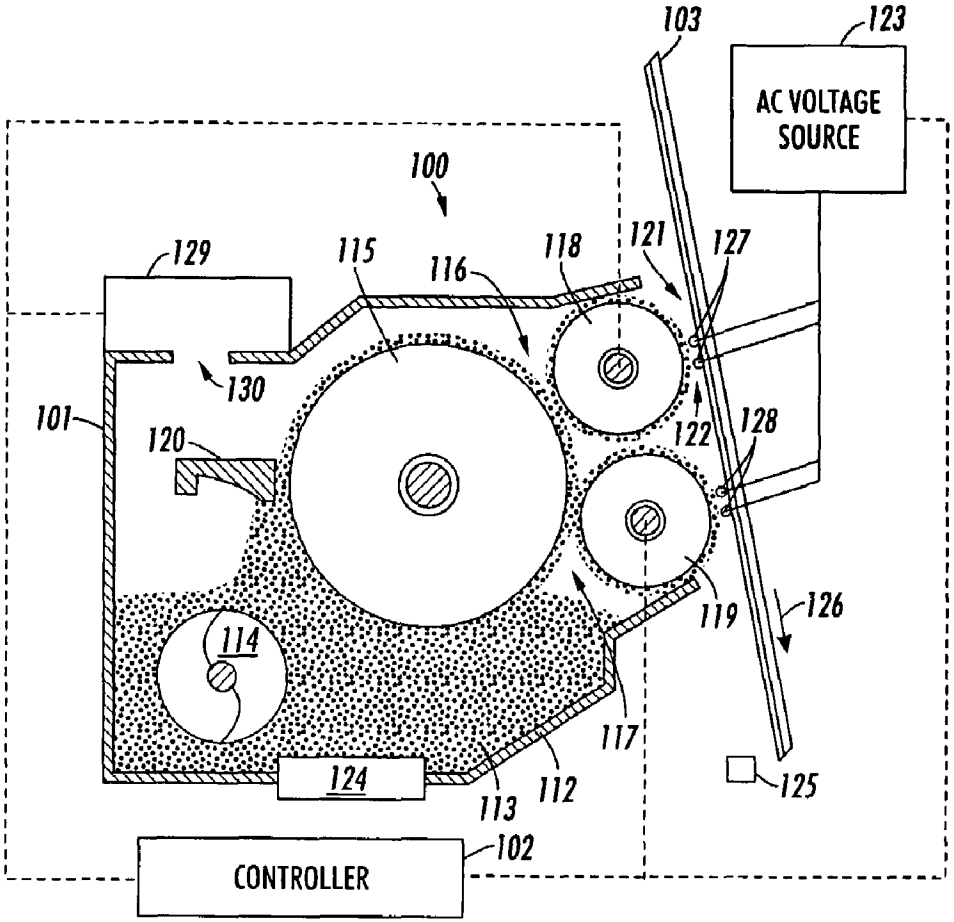
FIG. 2 illustrates a typical electrostatic marking system that can be used with the two dispenser system of this invention.

Referring now to FIG. 2, there are shown the details of an Hybrid scavengeless development (HSD) developer which is one system where the two dispenser system of this invention can be used. Obviously, the two dispenser system of FIG. 1 can be used with any other suitable marking or development system other than that shown in FIG. 2. Briefly, HSD technology deposits toner onto the surface of a donor roll via a conventional magnetic brush. The donor roll generally consists of a conductive core covered with a thin (50 to 200 micron) partially conductive layer. The magnetic brush roll is held at an electrical potential difference relative to the donor core to produce the field necessary for toner development. Applying an AC voltage to one or more electrode wires spaced between the donor roll and the imaging belt provides an electric field which is effective in detaching toner from the surface of the donor roll to produce and sustain an agitated cloud of toner particles about the wires, the height of the cloud being such as not to be substantially in contact with the belt. Typical AC voltages of the wires relative to the donor are 700-900 Vpp at frequencies of 5 15 kHz and may be applied as square waves, rather than pure sinusoidal waves. Toner from the cloud is then developed onto the nearby photoreceptor by fields created by a latent image. However, in another embodiment of the hybrid system, the electrode wires may be absent. For example, a hybrid jumping development system may be used wherein an AC voltage is applied to the donor roll, causing toner to be detached from the donor roll and projected towards the imaging member surface.

Continuing with FIG. 2, marking apparatus or development station 100 comprises a reservoir 112 containing original developer material 113 and receives the materials 110 and 111 from the dispensers 106 and 107 when practicing the present invention. Typically, the developer material may be either of the one component or two component type. For use in the present invention, developer material 113 is of the two component type, that is it comprises carrier granules and toner particles. The two-component developer material 113 may be of any suitable type. The use of an electrically conductive developer can eliminate the possibility of charge build-up within the developer material on the magnetic brush roll which, in turn, could adversely affect development at the second donor roll. In one embodiment, the two-component developer consists of 5-5 micron insulating toner particles, which are mixed with 50-100 micron conductive magnetic carrier granules such that the developer material comprises from about 90% to about 99% by weight of carrier and from 10% to about 1% by weight of toner. By way of example, the carrier granules of the developer material may include a ferromagnetic core having a thin layer of magnetite overcoated with a non-continuous layer of resinous material. The toner particles may be made from a resinous material, such as a vinyl polymer, mixed with a coloring material.

In FIG. 2, the reservoir or developer housing 101 comprises within the housing reservoir or housing auger or augers, indicated at 114, which are rotatably-mounted in the reservoir chamber. Augers 114 serve to transport and to agitate the material within the reservoir and encourage the toner particles to charge and adhere triboelectrically to the carrier granules. Magnetic brush roll 115 transports developer material 113 from the reservoir 112 to loading nips 116, 117 of donor rolls 118, 119. Magnetic brush rolls are well known, so the construction of roll 115 need not be described in great detail. Briefly the roll comprises a rotatable tubular housing within which is located a stationary magnetic cylinder having a plurality of magnetic poles impressed around its surface. The carrier granules of the developer material are magnetic and, as the tubular housing of the roll 115 rotates, the granules (with toner particles adhering triboelectrically thereto) are attracted to the roll 115 and are conveyed to the donor roll loading nips 116, 117. Metering blade 120 removes excess developer material from the magnetic brush roll 115 and ensures an even depth of coverage with developer material before arrival at the first donor roll loading nip 116.

At each of the donor roll loading nips 116, 117, toner particles are transferred from the magnetic brush roll 115 to the respective donor roll 118, 119. The carrier granules and any toner particles that remain on the magnetic brush roll 115 are returned to the reservoir 112 as the magnetic brush continues to rotate. The relative amounts of toner transferred from the magnetic roll 115 to the donor rolls 118, 119 can be adjusted, for example by applying different bias voltages to the donor rolls; adjusting the magnetic to donor roll spacing; adjusting the strength and shape of the magnetic field at the loading nips and/or adjusting the speeds of the donor rolls. Sensors can be used where suitable.

Each donor roll 118 and 119 transports the toner to a respective development zone 121, 122 through which the photoconductive belt 103 passes. At each of the development zones 121, 122, toner is transferred from the respective donor roll 118, 119 to the latent image on the photoconductor belt 103 to form a toner powder image on the belt 103. Various methods of achieving an adequate transfer of toner from a donor roll to a latent image on a imaging surface are known and any of those may be employed at the development zones 121, 122. Transfer of toner from the magnetic brush roll 115 to the donor rolls 118, 119 can be encouraged by, for example, the application of a suitable D.C. electrical bias to the magnetic brush and/or donor rolls. The D.C. bias (for example, approximately 70 V applied to the magnetic roll) establishes an electrostatic field between the donor roll 118 and 119 and magnetic brush rolls 115, which causes toner particles to be attracted to the donor roll 118 and 119 from the carrier granules on the magnetic brush roll 115.

In the device of FIG. 2, each of the development zones 121, 122 is shown as having a pair of electrode wires 127, 128 disposed in the space between each donor roll 118, 119 and belt 103. The electrode wires may be made from thin (for example, 50 to 100 micron diameter) stainless steel wires closely spaced from the respective donor roll. The wires are self-spaced from the donor rolls by the thickness of the toner on the donor rolls and may be within the range from about 5 micron to about 20 micron (typically about 10 micron) or the thickness of the toner layer on the donor roll.

For each of the donor rolls 118 and 119, the respective electrode wires 127 and 128 extend in a direction substantially parallel to the longitudinal axis of the donor roll. An alternating electrical bias is applied to the electrode wires by an AC voltage source 123. The applied AC establishes an alternating electrostatic field between each pair of wires and the respective donor roll, which is effective in detaching toner from the surface of the donor roll and forming a toner cloud about the wires, the height of the cloud being such as not to be substantially in contact with belt 103. The magnitude of the AC voltage in the order of 200 to 500 volts peak at frequency ranging from about 8 kHz to about 16 kHz. A DC bias supply (not shown) applied to each donor roll 118, 119 establishes electrostatic fields between the photoconductive belt 103 and donor rolls for attracting the detached toner particles from the clouds surrounding the wires to the latent image recorded on the photoconductive surface of the belt.

After development, excess toner may be stripped from donor rolls 118 and 119 by respective cleaning blades (not shown) so that magnetic brush roll 115 meters fresh toner to the clean donor rolls. As successive electrostatic latent images are developed, the toner particles within the developer material 113 are depleted. A developer dispenser 129 such as those generally described with reference to FIG. 2, stores a supply of toner particles, with carrier particles. The dispenser 129 is in operative communication with reservoir 112 and, as the concentration of toner particles in the developer material is decreased (or as carrier particles are removed from the reservoir as in a "trickle-through" system or in a material purge operation as discussed below), fresh material (toner and/or carrier from dispensers 106 and 107) are furnished to the developer material 113 in the reservoir 112. The auger 114 in the reservoir chamber mixes the fresh material with the remaining developer material so that the resultant developer material therein is substantially uniform with the concentration of toner particles being optimized. In this way, a substantially constant amount of toner particles is in the reservoir with the toner particles having a constant charge; this is an important aspect of the present invention. Developer housing 101 may also comprise at least one outlet 124 for removing developer material from the housing 101 in accordance with a developer material purge operation. The rectangle indicated as element 129 in the upper left portion of FIG. 2 represents the total structure of FIG. 1. The dispenser outlets 130 feed materials 110 and 111 directly or indirectly into reservoir 112 by any suitable means. Outlet 124 may further comprise a regulator (not shown) such as an auger or roller to assist in removing material from the housing.

Various sensors and components within developer apparatus 100 are in communication with system controller 102 which monitors and controls the operation of the developer apparatus to maintain the apparatus in an optimal state. In addition to voltage source 123, donor rolls 118 and 119, magnetic brush roll 115, augers 114, dispenser 129 and outlet 124, system controller 102 may, for example, communicate with a variety of sensors, including, for example, sensors to measure toner concentration, toner charge, toner humidity, the voltage bias of the developer material, bias of the magnetic brush roll, the bias of the donor roll, and image quality determined by sensor 125 adjacent imaged photoconductor layer 103.

In summary, the embodiments of the present invention provide an electrostatic marking system and a development station in operative relationship with other stations in said system. This development station comprises a developer housing enabled to hold toner and carrier. The housing is enabled to accommodate replenishing in the housing of the toner by a first dispenser with a replenishing material wherein a majority of the material by weight is toner particles, and enabled to accommodate the developer by a second dispenser with a replenishing material wherein a majority of the material by weight is carrier particles.

In this marking system the image quality of marks on a receiving medium is periodically gauged by a sensor to determine image quality and activation of at least one of the first and second dispensers. The first and second dispensers are independently controlled when adding contents to the housing or reservoir 112. Activation of the first and second dispenser is provided when image low area coverage of marks on a receiving medium results after extended periods of time.

This system is enabled to provide improved image quality and reduce developer waste over extended periods of use. At least the second dispenser is activated when a system sensor or actuator reaches a critical value in the housing.

Embodiments of this electrostatic marking system comprise, as above noted, a development station operatively connected to other stations in the system. The development station comprises a developer housing enabled to hold toner, carrier and at least one first sensor. The housing is also enabled to accommodate replenishing of materials in the housing by a first and second dispenser. The first dispenser is enabled to replenish toner in the housing. The first and second dispensers are enabled to be actuated when a system sensor or actuator in the housing reaches a predetermined critical value. This critical value is measured by at least one first sensor which is operatively connected to an actuation component which actuates either or both first and second dispensers.

The system is enabled to reduce a level of scheduled maintenance required for the system. The second dispenser is enabled to add and accept new developer to the housing and the system is enabled to dispense old developer for removal from the system. The first dispenser is enabled to dispense a material to the housing wherein a majority of said material by weight is toner particles. The second dispenser is enabled to dispense a material into the housing wherein a majority of the material by weight is carrier particles.

In this system, toner dispensed into the housing by either the first or second dispenser comprises toner that may be optimized for high developability, thereby allowing the developability of material in the housing to recover at a rate faster than if normal toner was dispensed therein. Fresh carrier dispensed or replenished to the housing is at a much lower amount, thereby minimizing a total amount of carrier dispersed into said system to minimize the quantity of developer waste generated by the printer.

As noted, the first and second dispensers are independently controlled. The development station is enabled to be retrofitted into existing electrostatic marking apparatus and reduced developer waste is provided by this novel development station.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

What is claimed is:

1. A development station useful in an electrostatic marking system comprising:

a developer housing configured to house toner and developer components, a dispenser configured to accommodate replenishing of materials in said developer housing, said dispenser comprising a first open-ended hopper which contains a toner material used to replenish said toner, and a second open-ended hopper which contains a developer material comprising from about 90%-99% by weight of carrier, a first sensor operatively connected in each of said hoppers to an activation component or controller which independently actuates said first and said second hoppers, both said first and said open-ended hoppers configured to independently discharge said materials to auger containing separate conveyor channels before said materials enter said developer housing, said conveyor channel each comprising an auger configured to agitate and transport said materials from said conveyor channels to said developing housing, wherein said first and second hoppers comprise independent controls configured to control and replenish contents to said auger containing conveyor channel and subsequently to said developer housing, and wherein said augers are configured to each separately agitate and transport said materials of said first and second open-ended hoppers respectively from said conveyor channels to said developer housing.

* * * * *